US006786975B1

(12) United States Patent
Long et al.

(10) Patent No.: US 6,786,975 B1
(45) Date of Patent: Sep. 7, 2004

(54) METHOD OF CLEANING PRINTHEAD IN INKJET PRINTER

(75) Inventors: Michael Long, Hilton, NY (US); Gregory J. Garbacz, Rochester, NY (US); Vincent E. Hamilton-Winbush, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/383,293

(22) Filed: Mar. 7, 2003

(51) Int. Cl.[7] ..... B08B 7/00

(52) U.S. Cl. ..... 134/4; 134/2; 134/3; 134/19; 134/42; 134/26; 510/170; 510/171; 510/174

(58) Field of Search ..... 134/2, 3, 4, 19, 134/26, 41, 42; 510/170, 171, 174

(56) References Cited

U.S. PATENT DOCUMENTS

| | | | | |
|---|---|---|---|---|
| 5,314,580 | A | 5/1994 | Di Tullio | |
| 5,660,684 | A | 8/1997 | Li et al. | |
| 6,265,363 | B1 | 7/2001 | Viscovitz | |
| 6,342,105 | B1 * | 1/2002 | Yano et al. | 134/42 |
| 6,451,103 | B1 | 9/2002 | Uemura et al. | |

* cited by examiner

*Primary Examiner*—Zeinab El-Arini
(74) *Attorney, Agent, or Firm*—Roger A. Fields

(57) ABSTRACT

A method of cleaning a printhead in an inkjet printer by removing organic debris deposits from the printhead, uses anyone of the liquid mixes of NaOCl (sodium hypochlorite) and $H_2O$ (water), $H_2O_2$ (hydrogen peroxide) and $H_2O$, $Na_2S_2O_4$ (sodium hydrosulfite) and $H_2O$, $CaCl_2O_2$ (calcium hypochlorite) and $H_2O$, or $KMnO_4$ (potassium pernanganate) and $H_2O$ on the debris deposits, to serve as a cleaning agent.

6 Claims, 1 Drawing Sheet

METHOD OF CLEANING PRINTHEAD IN INKJET PRINTER

FIELD OF THE INVENTION

The invention relates generally to inkjet printers, and in particular to a method of cleaning a printhead in an inkjet printer.

BACKGROUND OF THE INVENTION

Typically in continuous inkjet printers, a pressurized ink is formed into continuous inkjet filaments which project from closely spaced ink discharge nozzles in a nozzle plate on a printhead. Filament stimulation sources such as ink heaters or transducers operate as ink droplet generators each time they are activated, by causing filament end-lengths to be broken off at the respective nozzles. The broken-off filament end-lengths form discrete ink droplets which are deposited on a print medium moving relative to the printhead. The interval between successive droplet break-offs at any one nozzle matches the interval between successive activation's of the filament stimulation source for that nozzle. The longer the interval between successive activation's of the filament stimulation source for the nozzle, the longer the opportunity for the continuous inkjet filament to increase lengthwise at the nozzle and the larger the ink droplet. Conversely, the shorter the interval between successive activation's of the filament stimulation source for the nozzle, the shorter the opportunity for the continuous inkjet filament to increase lengthwise at the nozzle and the smaller the ink droplet. Thus, the volume of the ink droplet, when a droplet break-off occurs at the nozzle, corresponds to the frequency of activation of the filament stimulation source for the nozzle.

Successive ink droplets resulting from droplet break-off at the nozzles often are altered between printing and non-printing trajectories or paths. Those ink droplets that are in a printing trajectory are allowed to reach the print medium. Those ink droplets that are in a non-printing trajectory can be collected in a ink gutter or catcher and then recycled back to an ink reservoir that empties into the nozzles in the printhead.

A known problem is that organic debris deposits such as dirt, dried ink, and/or microorganisms can accumulate within the nozzles and/or within the ink reservoir for the nozzles. Moreover, the debris deposits can accumulate on the nozzle plate, particularly in the regions that droplet break-off occurs at the nozzles. The debris deposits must be removed. Any debris deposits on the nozzle plate, in the regions that droplet break-off occurs at the nozzles, can cause the ink droplets to be misdirected from the printing trajectory that they should take to reach the print medium. Consequently, the printed image may be of a lesser quality. Any debris deposits within the nozzles can render the nozzles defective by clogging them.

Cleaning to remove the debris deposits from the printhead can be done by flushing a cleaning solvent under positive pressure into the ink reservoir and outwardly through the nozzles, and by flushing the cleaning solvent over the nozzle plate.

SUMMARY OF THE INVENTION

A method of cleaning a printhead in an inkjet printer by removing organic debris deposits from the printhead, said method comprising:

applying anyone of the liquid mixes of NaOCl (sodium hypochlorite) and $H_2O$ (water), $H_2O_2$ (hydrogen peroxide) and $H_2O$, $Na_2S_2O_4$ (sodium hydrosulfite) and $H_2O$, $CaCl_2O_2$ (calcium hypochlorite) and $H_2O$, or $KMnO_4$ (potassium pernanganate) and $H_2O$ on the debris deposits, to serve as a cleaning agent;

drying the cleaning agent applied on the debris deposits, to leave a residue with the debris deposits; and washing the residue with the debris deposits off the printhead. Preferably, the cleaning agent applied on the debris deposits crystallizes on the debris deposits during drying in order to leave the residue with the debris deposits and to shrink the debris deposits.

DETAILED DESCRIPTION OF THE INVENTION

Figure 1:
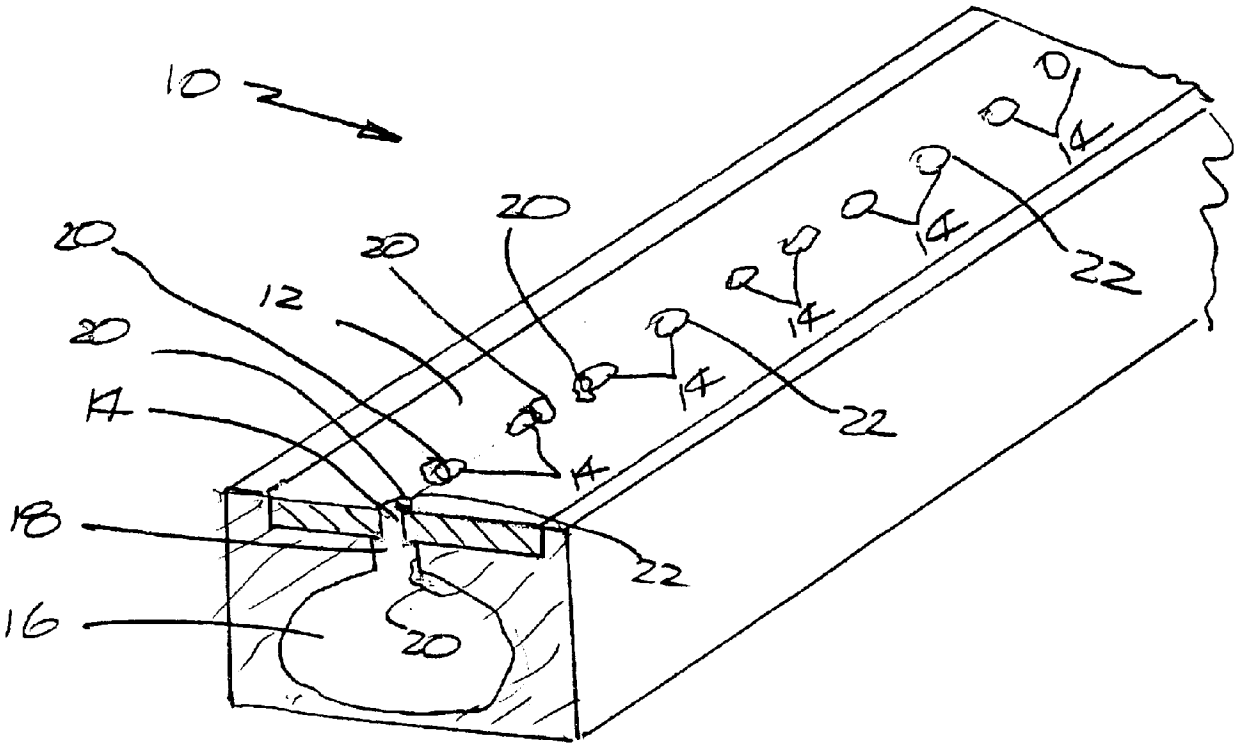
FIG. 1 shows a printhead 10 in a continuous inkjet printer that is cleaned according to a preferred embodiment of the invention.

A preferred embodiment of the invention constitutes a method of cleaning a printhead, for example, in a continuous inkjet printer. Because the features of the printhead are generally known, the description of the invention which follows is directed in particular only to those elements of the printhead that are germane to the method.

FIG. 1 shows a printhead 10 in a continuous inkjet printer. The printhead 10 has a nozzle plate 12 including multiple, closely spaced, ink discharge nozzles 14, and a single ink reservoir 16 that empties into the nozzles via a slot 18. The nozzles 14 each have a 10 micrometer (um) internal diameter.

A known problem is that organic debris deposits 20 (only several shown in FIG. 1) such as dirt, dried ink, and/or microorganisms, can accumulate within the nozzles 14 and/or within the ink reservoir 16 and the slot 18. Moreover, the debris deposits 20 can accumulate on the nozzle plate 12, particularly in the regions immediately surrounding the nozzle openings 22 on the nozzle plate. The debris deposits 20 must be removed.

A method of removing the debris deposits 20 from the printhead 10 is as follows.

To begin with, a preferred cleaning agent is a liquid mix of NaOCl (sodium hypochlorite) and $H_2O$ (water). The NaOCl (sodium hypochlorite) and $H_2O$ are mixed at a rate of approximately 5.25% NaOCl and 94.75% $H_2O$. Alternative cleaning agents can be liquid mixes of $H_2O_2$ (hydrogen peroxide) and $H_2O$, $Na_2S_2O_4$ (sodium hydrosulfite) and $H_2O$, $CaCl_2O_2$ (calcium hypochlorite) and $H_2O$, and $KMnO_4$ (potassium permanganate) and $H_2O$. Each the alternative agents can be mixed with water at substantially the same rate as NaOCl is mixed with water.

According to the method, using the preferred cleaning agent NaOCl in $H_2O$, the cleaning agent is applied to the nozzle plate 12 at least to thoroughly cover the debris deposits 20 on the nozzle plates. Moreover, the cleaning agent is applied within the nozzles 14 and within the ink reservoir 16 and the slot 18 to thoroughly cover the debris deposits 20 within the nozzles, the ink reservoir and the slot. The cleaning agent can be applied using a known application technique such as by pressure-spraying, immersion, dripping, etc.

Next, the applied agent is allowed to dry for a period, e.g. seven to fifteen minutes, that as is known depends on the application technique used, the ambient humidity and temperature, the particular cleaning agent used, etc. The period for drying must be sufficient for the cleaning agent to crystallize as an attachment to each debris deposit 20, that is, to nucleate on each debris deposit. After about four minutes, when the cleaning agent is NaCl in $H_2O$, the cleaning agent becomes supersaturated and begins to crystallize. Then, as the cleaning agent further crystallizes, each debris deposit 20 tends to proportionally shrink, e.g. from a 15 um diameter to a 5 um diameter or less on the nozzle plate 12.

During drying, when the cleaning agent is NaCl in $H_2O$, the $H_2O$ evaporates entirely, the Na crystallizes, entirely, and the Cl crystallizes substantially (that is, a slight amount of the Cl vaporizes with the $H_2O$ evaporating).

Next, the nozzle plate 12, the nozzles 14, the reservoir 16 and the slot 18 are thoroughly washed to remove the crystallized agent and attached shrunken debris deposits such as by spraying them with de-ionized or otherwise suitably clean water. This dissolves the crystallized agent and separates the shrunken debris deposits from the nozzle plate 12, the nozzles 14, the reservoir 16 and the slot 18. Simultaneously, the dissolved agent and the separated debris deposits are aspirated (vacuumed) from the nozzle plate 12, the nozzles 14, the reservoir 16 and the slot 18.

The invention has been described in detail with particular reference to certain preferred embodiments thereof, but it will be understood that variations and modifications can be effected within the spirit and scope of the invention.

PARTS LIST

10. printhead
12. nozzle plate
14. nozzles
16. ink resevoir
18. slot
20. debris deposits
22. nozzle openings

What is claimed is:

1. A method of cleaning a printhead in an inkjet printer by removing organic debris deposits from the printhead, said method comprising:

applying anyone of the liquid mixes of NaOCl (sodium hypochlorite) and $H_2O$ (water), $H_2O_2$ (hydrogen peroxide) and $H_2O$, $Na_2S_2O_4$ (sodium hydrosulfite) and $H_2O$, $CaCl_2O_2$ (calcium hypochlorite) and $H_2O$, or $KMnO_4$ (potassium pernanganate) and $H_2O$ on the debris deposits, to serve as a cleaning agent;

drying the cleaning agent applied on the debris deposits, to leave a residue with the debris deposits; and washing the residue with the debris deposits off the printhead.

2. A method as recited in claim 1, wherein the cleaning agent applied on the debris deposits crystallizes on the debris deposits during drying in order to leave the residue with the debris deposits.

3. A method as recited in claim 2, wherein the cleaning agent applied on the debris deposits is a liquid mix of NaOCl and $H_2O$, and the $H_2O$ evaporates during drying which leaves the Na and Cl crystallized.

4. A method as recited in claim 2, wherein the residue with the debris deposits are washed off the printhead using de-ionized or otherwise suitable clean $H_2O$ to dissolve the residue and separate the debris deposits from the printhead.

5. A method as recited in claim 1, wherein the cleaning agent applied on the debris deposits crystallizes on the debris deposits during drying in order to leave the residue with the debris deposits and to shrink the debris deposits.

6. A method as recited in claim 1, wherein the cleaning agent applied on the debris deposits is a liquid mix of NaOCl and $H_2O$ mixed at a rate of approximately 5.25% NaOCl and 94.75% $H_2O$.

* * * * *

UNITED STATES PATENT AND TRADEMARK OFFICE

CERTIFICATE OF CORRECTION

PATENT NO. : 6,786,975 B1
DATED : September 7, 2004
INVENTOR(S) : Michael Long et al.

It is certified that error appears in the above-identified patent and that said Letters Patent is hereby corrected as shown below:

Column 4,
Line 9, change “pernanganate” to -- permanganate --

Signed and Sealed this

First Day of February, 2005

JON W. DUDAS
*Director of the United States Patent and Trademark Office*